US007677761B2

(12) United States Patent
Chiang

(10) Patent No.: US 7,677,761 B2
(45) Date of Patent: Mar. 16, 2010

(54) LIGHT-EMITTING DIODE STACKED LIGHTING CORE FOR LAMP BULB

(76) Inventor: Wen-Chiang Chiang, Hua Cheng Rd., Hsin Chuang, Taipei Hsien (TW)

( * ) Notice: Subject to any disclaimer, the term of this patent is extended or adjusted under 35 U.S.C. 154(b) by 198 days.

(21) Appl. No.: 11/934,794

(22) Filed: Nov. 5, 2007

(65) Prior Publication Data

US 2009/0116236 A1 May 7, 2009

(51) Int. Cl.
*F21V 29/00* (2006.01)

(52) U.S. Cl. ..... 362/240; 362/249.02; 362/249.11; 362/800; 340/815.45

(58) Field of Classification Search ..... 362/294, 362/800, 649, 650
See application file for complete search history.

(56) References Cited

U.S. PATENT DOCUMENTS 6,565,231 B1 * 5/2003 Cok ..... 362/653
6,580,228 B1 * 6/2003 Chen et al. ..... 315/185 R

* cited by examiner

*Primary Examiner*—Anabel M Ton
(74) *Attorney, Agent, or Firm*—patenttm.us

(57) ABSTRACT

A light-emitting diode stacked lighting core includes a core top board, a core bottom board, and vertical boards, all being circuit boards. The core top board and the vertical boards are provided with light-emitting diodes and the core bottom board is provided with a circuit that is formed of a rectifier and a voltage reduction element and having two terminals extending outward. The vertical boards form extended fitting tabs and the core top board and the core bottom board respectively form openings corresponding to the fitting tabs to receive the fitting tabs to fit therein and to be fixed thereto by means of soldering, whereby the light-emitting diodes of the core top board and the vertical boards are put in electrical connection with each other to form the lighting core that is receivable and fixed in a light-transmitting enclosure.

3 Claims, 5 Drawing Sheets

LIGHT-EMITTING DIODE STACKED LIGHTING CORE FOR LAMP BULB

BACKGROUND OF THE INVENTION (a) Technical Field of the Invention

The present invention relates to a lighting device, and in particular to a lighting core of a lamp bulb, which comprises interconnected circuit boards to effectively aggregate a great number of light-emitting diodes on the circuit board, serving as a lighting core or a lampwick for an electronic lamp bulb, providing a breakthrough of the conventional electronic lighting technology, which ensures enhanced brightness as compared to the conventional lighting technology, and also features the advantages of being hard to break, low emission of thermal energy, and reduction of power consumption in operation.

(b) Description of the Prior Art

The modern society rely heavily on electrical power for lighting the night. In this respect, a lighting device is of irreplaceable and important role, which provides lighting for various important applications in human society, including household and commercial lighting, transportation lighting, such as headlight of automobiles and traffic lighting.

The most commonly seen lighting device is a lamp bulb, as shown in FIG. 1, which comprises a conductive base 1 from which filaments for giving off light and heat extend and a glass bulb 3 mounted to the base 1 to enclose the filaments 2. An inert gas is filled in the bulb 3 to reduce thermal damage to the filaments and thus extending service life thereof. Such a structure is simple and works well and reliably for lighting purposes. However, in the viewpoint of environmental protection, the conventional lamp bulb suffers drawbacks:

(1) The glass bulb is easy to break due to any undesired impact with an rigid object and this makes the lamp bulb an early trash;

(2) Based on researches, the lighting efficiency of the lamp bulb that is operated by heating the filaments is very low and careful inspection of the brightness of light emitted by the lamp bulb and the energy it consumes reveals that the lamp bulb is in fact an extremely power consuming device; and (3) Besides light, the lamp bulb also emits a great amount of heat when it is in operation, which consumes a lot of power, so that the conversion of electrical power into light is of very low efficiency.

Due to the short of resources of the Earth, using lamp bulb to consumes additional energy to deprive of the natural resources is no long acceptable to the human society and it is desired to have a lighting device that reduce power consumption, is more durable, emits less amount of heat, and provides more bright lighting in order to overcome the drawbacks of the conventional lamp bulb.

SUMMARY OF THE INVENTION

The primary purpose of the present invention is to provide a light-emitting diode stacked lighting core comprising a core top board, a core bottom board, conductor lines connecting the core top board and the core bottom board, a plurality of vertical boards, a plurality of light-emitting diodes, a plurality of rectifiers, and a voltage reduction element, wherein the core top board, the core bottom board, and the vertical boards are all embodied as circuit boards. The core top board and the vertical boards each have an outside surface on which the light-emitting diodes are arranged and are further provided with the rectifiers at suitable locations. The core bottom board is provided with a circuit that is formed of one of the rectifiers and the voltage reduction element and having two terminals extending downward beyond the core bottom board for coupling with a base of an outer enclosure of an electronic lamp bulb. Opposite ends of each vertical board form extended fitting tabs and the core top board and the core bottom board respectively form openings corresponding to the fitting tabs to receive the fitting tabs fit therein and fixed thereto by means of soldering, whereby the light-emitting diodes of the core top board and the vertical boards are put in electrical connection with each other to form the lighting core that is receivable and fixed in the enclosure of the electronic lamp bulb, which is made light-transmitting. As such, a great number of light-emitting diodes are aggregated on the circuit boards to form a lighting core that ensures enhanced brightness as compared to the conventional lighting technology.

Further, the light-emitting diode stacked lighting core in accordance with the present invention provides an enhanced lighting effect, and this allows the lighting core of the present invention to be used in applications other than indictors, which requires only very limited brightness, and serving as a regular lighting devices for household and commercial lighting purposes. Further, due to the nature of low heat emission of the light-emitting diode, the lighting core of the present invention, which is formed by aggregating a number of light-emitting diode, besides featuring enhanced light brightness, does not cause high temperature when put in operation. Thus, the enclosure of the lighting core can be made of plastics, which are less heat resistant, without concerns of melting or burning of the plastic enclosure caused by high temperature. The plastic enclosure is advantageous in being more durable than glass bulb and does not simple break due to external impact.

Further, due to the nature of consuming less energy of the light-emitting diode, the lighting core of the present invention, which is formed by aggregating light-emitting diodes, features enhanced brightness with less consumption of electrical power.

Further, the lighting core of the present invention, which is formed of aggregating light-emitting diodes, has circuits arranged in such a way that the light-emitting diodes are parallel connected to each other so that any one of the light-emitting diodes is broken does not affect the other light-emitting diodes, whereby only the overall brightness is slightly reduced, which is still acceptable to the applications where precise lighting such as that required in photographing is not necessary and the service life thereof can be extended until most of the light-emitting diodes fail or break and a substantial reduction of the overall brightness is caused. This is certainly of help in reducing the amount of trash and good to environmental protection.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set fort in the appended claims.

Figure 1:
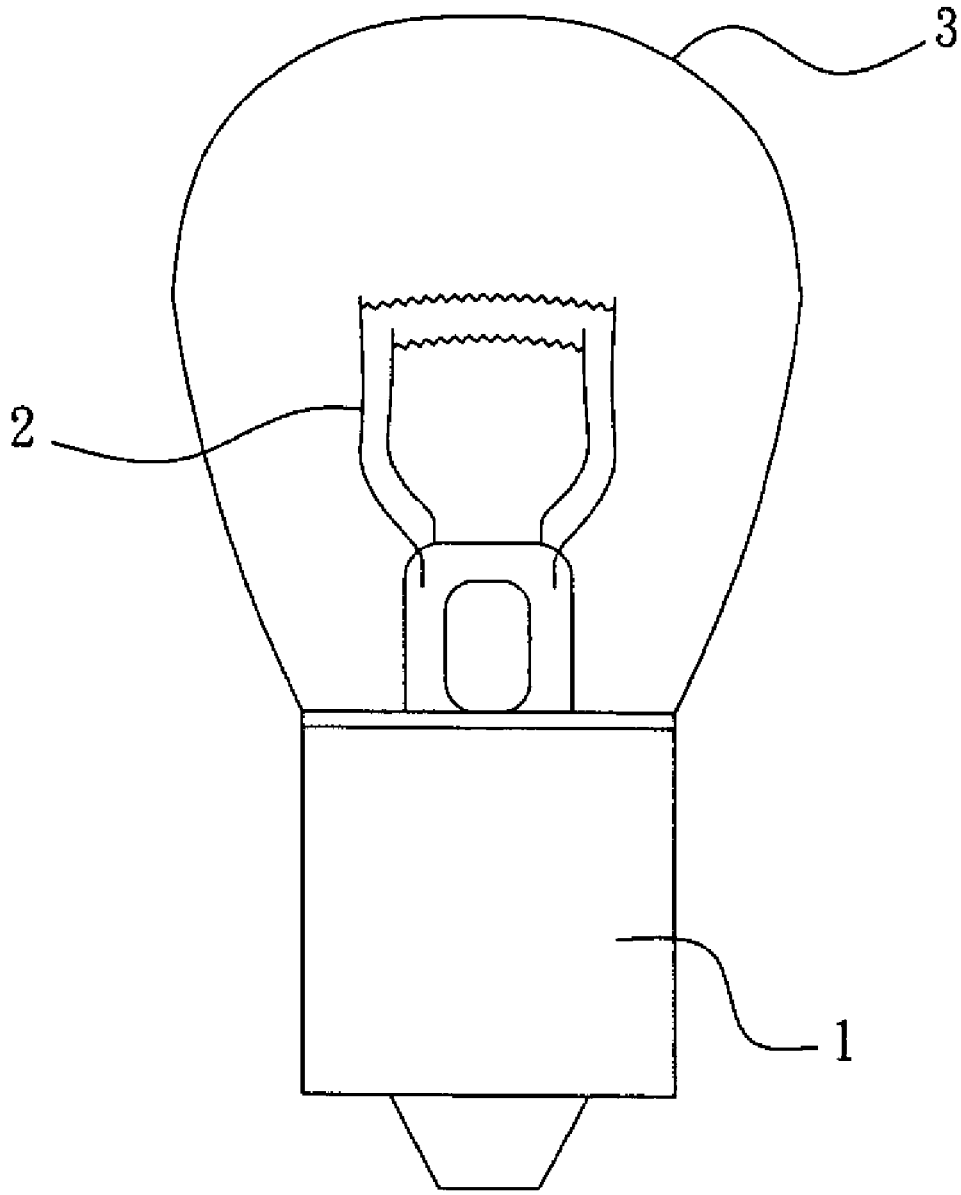
PRIOR ART FIG . 1
FIG. 1 is a side elevational view of a conventional lamp bulb.
Figure 2:
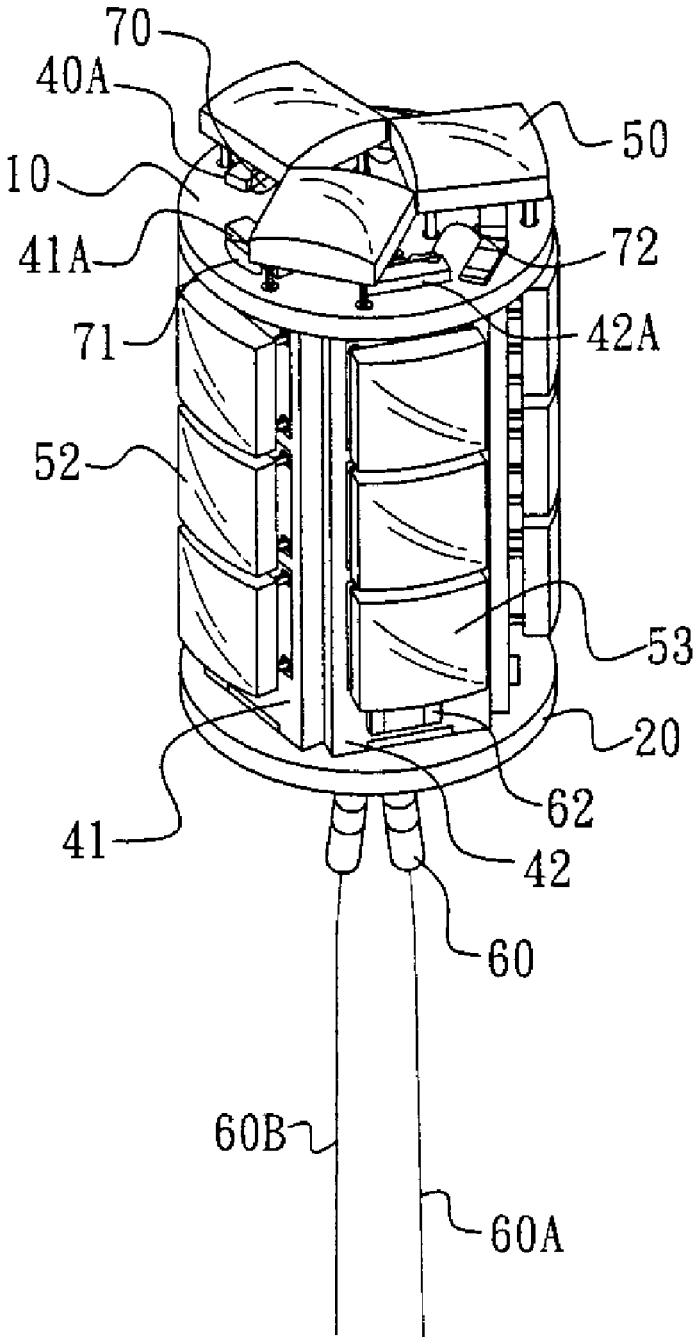
FIG. 2 is a perspective view showing a light-emitting diode stacked lighting core constructed in accordance with the present invention.
Figure 3:
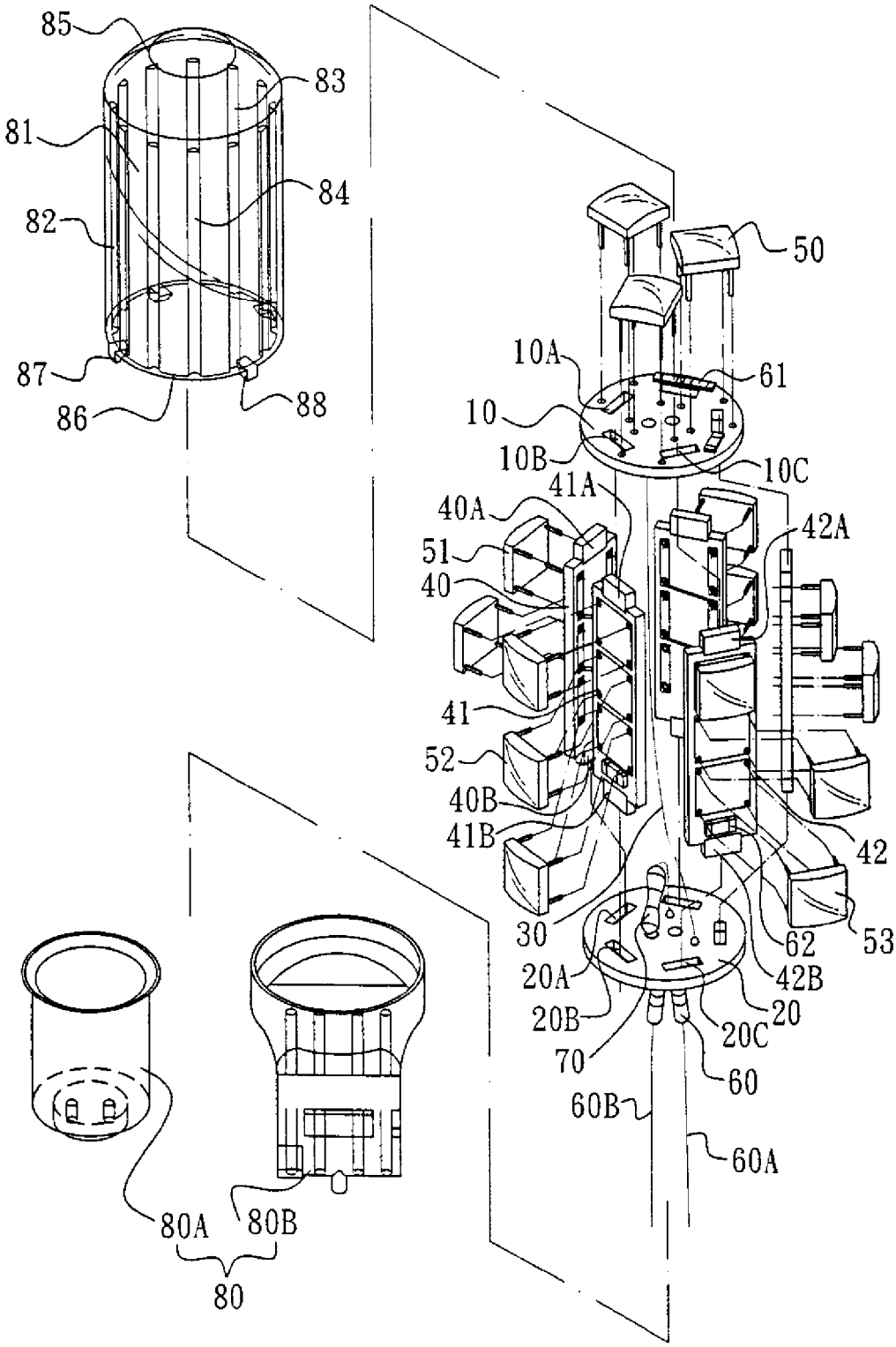
FIG. 3 is an exploded view of the light-emitting diode stacked lighting core of the present invention.
Figure 4:
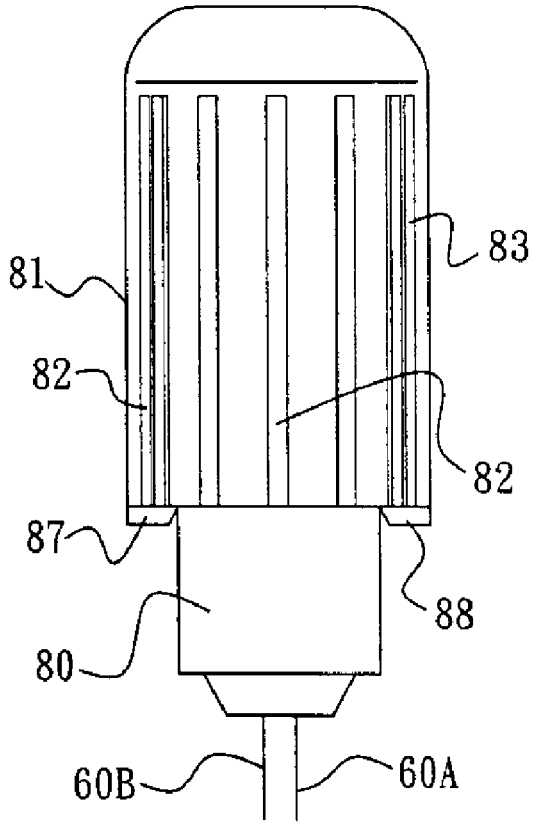
FIG. 4 is a side elevational view of a lamp bulb containing the lighting core of the present invention.
Figure 5:
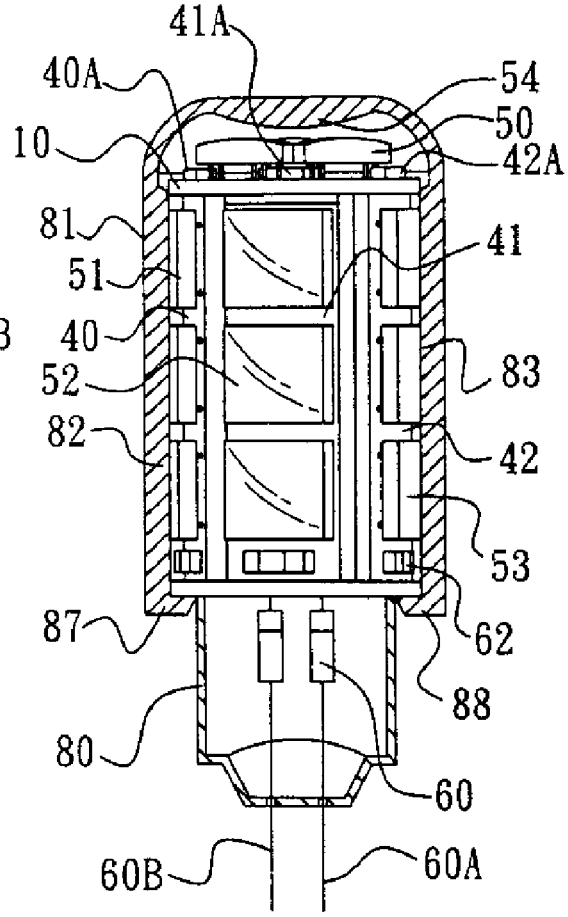
FIG. 5 is a cross-sectional view of the lamp bulb containing the lighting core of the present invention.

With reference to the drawings and in particular to FIGS. 2 and 3, which respectively show a perspective view and an exploded view of a light-emitting diode stacked lighting core constructed in accordance with the present invention, and FIGS. 4 and 5, which respectively show a side elevational view and a cross-sectional view of a lamp bulb containing the lighting core of the present invention, the light-emitting diode stacked lighting core constructed in accordance with the present invention comprises a core top board 10, a core bottom bore 20, conductor lines 30 electrically connecting the core top board 10 and the core bottom board 20, a plurality of vertical boards 40, 41, 42, a plurality of light-emitting diodes 50, 51, 52, 53, a plurality of rectifiers 60, 61, 52, and a voltage reduction element 70. The core top board 10, the core bottom board 20, and the vertical boards 40, 41, 42 are all circuit boards in the embodiment illustrated. The core top board 10 and core bottom board 20 are separated from each other by an interval, the vertical boards 40, 41, 42 are mounted vertically in the interval between the core top board 10 and the core bottom board 20 so that the core top board 10, the core bottom board 20 and vertical boards 40, 41, 42 cooperate to define a hollow space therebetween. The core top board 10 and the vertical boards 40, 41, 42 are both provided, on an outside surface thereof, the light-emitting diodes 50, 51, 52, 53, preferably in a line-up manner, and are further provided with the rectifiers 61, 62 at suitable locations in proper electrical connection therewith. The rectifier 60 and the voltage reduction element 70 together form a circuit that is arranged on the core bottom board 20, with two terminals 60A, 60B of the circuit formed of the rectifier 60 and the voltage reduction element 70 extending downward beyond the core bottom board 20 for coupling with a base 80 of an outer enclosure 81 of the light bulb. As shown in FIG. 3, the base 80 can be a metal cap 80A or a plastic cap 80B that allows the two terminals 60A, 60B to extend outside. Opposite ends of each vertical board 40, 41, 42 form extended fitting tabs 40A, 40B, 41A, 41B, 42A, 42B and the core top board 10 and the core bottom board 20 respectively form openings 10A, 10B, 10C, 20A, 20B, 20C at locations corresponding to the fitting tabs 40A, 40B, 41A, 41B, 42A, 42B of the vertical boards 40, 41, 42 to receive the fitting tabs 40A, 40B, 41A, 41B, 42A, 42B to fit therein and to be fixed thereto by means of soldering 71, 72, 73 to establish electrical connection therebetween.

With the soldered connections between the fitting tabs 40A, 40B, 41A, 41B, 42A, 42B of the vertical boards 40, 41, 42 and the openings 10A, 10B, 10C, 20A, 20B, 20C of the core top board 10 and the core bottom board 20, the light-emitting diodes 50, 51, 52, 53 of the core top board 10 and the vertical boards 40, 41, 42 are in electrical connection with each other in a parallel connected manner and are arranged in a stacked manner as a vertical column-like core, as shown in FIGS. 4 and 5. Such a lighting core is received and retained in the enclosure 81, which is made light-transmitting, and which is coupled to the base 80 to form an individual unitary lighting device for easy replacement.

Figure 6:
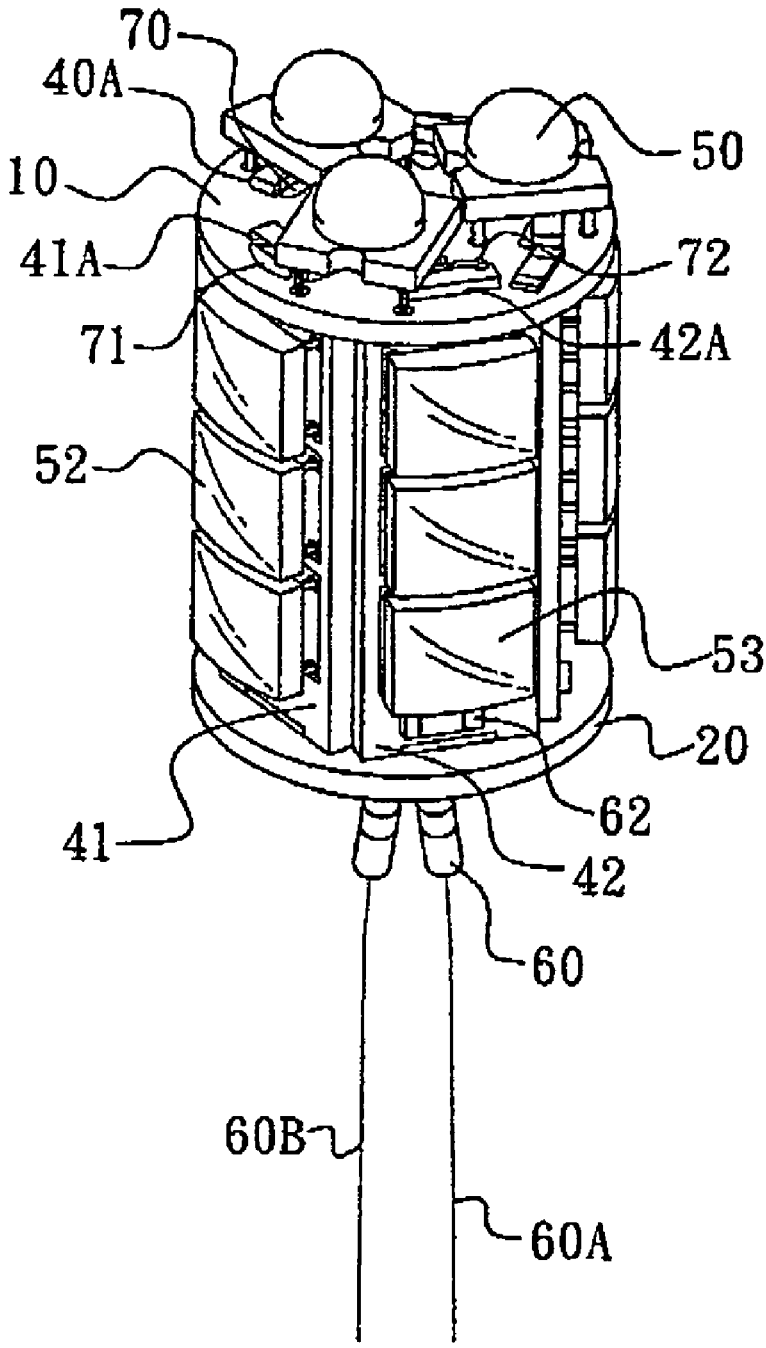
FIG. 6 is a perspective view showing a light-emitting diode stacked lighting core constructed in accordance with an other embodiment of the present invention.

The enclosure 81 is preferably made of high light transmission plastic materials and has a circumferential side wall having an inside surface forming raised ribs 82, 83, 84 that refract the light beams transmitting therethrough so that the light transmitting through the ribs 82, 83, 84 is subjected to refraction to induce varying lighting effect. The enclosure 81 has a closed top forming centrally a convex lens 85, which functions to converge light for extension the lighting effect to a further location. Further, the enclosure 81 has a bottom opening 86, which is sized to receive and thus enclose the core bottom board 20. Formed along a circumferential rim of the bottom opening 86 are pawl-like fasteners 87, 88 that are preferably equally spaced for engaging and thus fixing to a bottom surface of the core bottom board 20. A bonding agent, such as hot melt glues, may be filled in a gap or clearance between the enclosure 81 and the core bottom board 20, as well as gaps adjacent to the fasteners 87, 88 to ensure water tightness. Further, besides the stacked and parallel-connected arrangement discussed above with reference to FIGS. 2-5, the present invention can be embodied in different ways, such as that shown in FIG. 6, in which the light-emitting diodes 50 that are mounted to the core top plate 10 are each provided with a convex lens 54.

Apparently, the light-emitting diode stacked lighting core in accordance with the present invention combines a great number of light-emitting diodes to form a lighting core that gives off light more bright than the conventional lighting device and is advantageous in being hard to break and being more durable, emitting less amount of thermal energy, and consuming less energy in operation.

Although the present invention has been described with reference to the preferred embodiments thereof it is apparent to those skilled in the art that a variety of modifications and changes may be made without departing from the scope of the present invention which is intended to be defined by the appended claims.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A light-emitting diode stacked lighting core comprising a core top board, a core bottom board, conductor lines connecting the core top board and the core bottom board, a plurality of vertical boards, a plurality of light-emitting diodes, a plurality of rectifiers, and a voltage reduction element, wherein the core top board, the core bottom board, and the vertical boards are all embodied as circuit boards, the core top board and core bottom board are separated from each other by an interval, the vertical boards are mounted vertically in the interval between the core top board and the core bottom board so that the core top board, the core bottom board and vertical boards cooperate to define a hollow space therebetween, the core top board and the vertical boards each having an outside surface on which the light-emitting diodes are arranged, the circuit boards being further provided with the rectifiers at suitable locations, the core bottom board being provided with a circuit that is formed of one of the rectifiers and the voltage reduction element and having two terminals extending downward beyond the core bottom board for coupling with a base of an outer enclosure; and wherein opposite ends of each vertical board form extended fitting tabs and the core top board and the core bottom board respectively form openings corresponding to the fitting tabs to receive the fitting tabs to fit therein and to be fixed thereto by means of soldering, whereby the light-emitting diodes of the core top board and the vertical boards are put in electrical connection with each other to form the lighting core that is receivable and fixed in the enclosure.

2. The light-emitting diode stacked lighting core as claimed in claim 1, wherein the enclosure is made of high light transmission plastic materials and has a circumferential side wall having an inside surface forming raised ribs that refract the light transmitting therethrough, the enclosure having a closed top forming a convex lens and an open bottom, which is fit over and closed by the core bottom board, pawl fasteners being formed along a circumferential rim of the open bottom for engaging and thus fixing to a bottom surface of the core bottom board.

3. The light-emitting diode stacked lighting core as claimed in claim 1, wherein the light-emitting diodes mounted to the core top board are each provided with a convex lens.

* * * * *